US010627158B2

(12) United States Patent
Repasky et al.

(10) Patent No.: US 10,627,158 B2
(45) Date of Patent: Apr. 21, 2020

(54) COPRODUCTION OF LIQUEFIED NATURAL GAS AND ELECTRIC POWER WITH REFRIGERATION RECOVERY

(71) Applicant: General Electric Company, Schenectady, NY (US)

(72) Inventors: John Michael Repasky, Schertz, TX (US); David Kennedy, Schertz, TX (US)

(73) Assignee: Baker Hughes, a GE Company, LLC, Schenectady, NY (US)

( * ) Notice: Subject to any disclaimer, the term of this patent is extended or adjusted under 35 U.S.C. 154(b) by 270 days.

(21) Appl. No.: 15/457,611

(22) Filed: Mar. 13, 2017

(65) Prior Publication Data

US 2018/0259249 A1 Sep. 13, 2018

(51) Int. Cl.
*F25J 1/02* (2006.01)
*F25J 1/00* (2006.01)

(52) U.S. Cl.
CPC ..... *F25J 1/023* (2013.01); *F25J 1/004* (2013.01); *F25J 1/0022* (2013.01); *F25J 1/0052* (2013.01); *F25J 1/0212* (2013.01); *F25J 1/0236* (2013.01); *F25J 1/0242* (2013.01); *F25J 1/0267* (2013.01); *F25J 1/0284* (2013.01); *F25J 1/0296* (2013.01); *F25J 2240/70* (2013.01); *F25J 2240/82* (2013.01); *F25J 2245/90* (2013.01)

(58) Field of Classification Search
CPC .. F25J 1/023; F25J 1/0022; F25J 1/004; F25J 1/0052; F25J 1/0212; F25J 1/0236; F25J 1/0242; F25J 1/0267; F25J 1/0284; F25J 1/0296; F25J 2240/70; F25J 2240/82; F25J 2245/90; F25J 3/0209; F25J 3/0233; F25J 3/0238; F25J 3/0242; F25J 5/005; F25J 2250/20; B63B 25/16; B63H 21/38; B01D 3/322
USPC ..... 62/621–628
See application file for complete search history.

(56) References Cited

U.S. PATENT DOCUMENTS 3,919,852 A * 11/1975 Jones ..... F25J 1/0025 60/651
8,381,544 B2 * 2/2013 Coyle ..... F25J 1/0022 137/6
9,003,828 B2 * 4/2015 Bridgwood ..... F25J 1/0022 62/611
9,657,246 B2 * 5/2017 Barclay ..... C10L 3/10
2003/0154739 A1 8/2003 Fanning et al.
(Continued)

FOREIGN PATENT DOCUMENTS

WO 2014173599 A2 10/2014

OTHER PUBLICATIONS

Smith et al., "Capturing an Opportunity—NGLRecovery from RasGas LNG Train 4", Gastech, 15 pages (2005).

*Primary Examiner* — Melvin Jones
(74) *Attorney, Agent, or Firm* — Mintz Levin Cohn Ferris Glovsky and Popeo, P.C.

(57) ABSTRACT

Systems and methods for increasing the efficiency of liquefied natural gas (LNG) production, as well as facilitating coproduction of electric power, and compressed natural gas (CNG) are described. The systems and methods facilitate producing an intermediate LNG at a higher temperature, recovering refrigeration from flash gas and boil-off gas from the LNG, using flash-gas and boil-off gas as fuel to generate electric power, and providing LNG, CNG, and electric power to a vehicle fueling facility.

12 Claims, 5 Drawing Sheets

(56) References Cited

U.S. PATENT DOCUMENTS

| | | | | |
|---|---|---|---|---|
| 2006/0137391 | A1* | 6/2006 | Baudat | F25J 1/0022 62/611 |
| 2007/0193303 | A1 | 8/2007 | Hawrysz et al. | |
| 2010/0175425 | A1* | 7/2010 | Walther | F25J 1/0022 62/623 |
| 2010/0263400 | A1* | 10/2010 | Tachibana | B01D 61/025 62/389 |
| 2012/0240600 | A1 | 9/2012 | Paulus et al. | |
| 2012/0279728 | A1* | 11/2012 | Northrop | B01D 53/1462 166/401 |
| 2014/0182331 | A1* | 7/2014 | Burmberger | F25J 1/0022 62/630 |
| 2014/0352330 | A1* | 12/2014 | Baek | F17C 9/02 62/48.1 |
| 2015/0316316 | A1* | 11/2015 | Oelfke | F25J 1/0231 62/611 |
| 2016/0138861 | A1* | 5/2016 | Ohart | F25J 1/0022 62/613 |
| 2016/0298898 | A1 | 10/2016 | Ducote, Jr. et al. | |
| 2016/0313057 | A1* | 10/2016 | Roberts | F25J 1/0082 |
| 2017/0010042 | A1* | 1/2017 | Kerth | F25J 1/0022 |
| 2017/0016668 | A1* | 1/2017 | Pierre, Jr. | F25J 3/08 |

* cited by examiner

COPRODUCTION OF LIQUEFIED NATURAL GAS AND ELECTRIC POWER WITH REFRIGERATION RECOVERY

FIELD

Liquefaction systems and processes are provided, and in particular systems and methods are provided for increasing the efficiency of liquefied natural gas production.

BACKGROUND

Liquefied natural gas, referred to in abbreviated form as "LNG," is a natural gas which has been cooled to a temperature of approximately −162 degrees Celsius with a pressure of up to approximately 25 kPa (4 psig) and has thereby taken on a liquid state. Natural gas (NG) is primarily composed of methane, and can include ethane, propane, and heavy hydrocarbon components such as butanes, pentanes, hexanes, benzene, toluene, ethylbenzene, and xylenes. Many natural gas sources are located a significant distance away from the end-consumers. One cost-effective method of transporting natural gas over long distances is to liquefy the natural gas and to transport it in tanker ships, also known as LNG-tankers. The LNG is transformed back into gaseous natural gas at the destination.

In a typical liquefaction process a compressor is used to deliver pressurized mixed refrigerant (MR) to a cold box, which in turn is used to cool a feedstock, such as a natural gas, to form a liquefied gas. Cryogenic refrigeration systems, which are used in the production of LNG, require a significant amount of power to operate, and they tend to have a high capital cost. Accordingly, there is a need for methods and devices for increasing the efficiency of cryogenic refrigeration systems that are used in the production of LNG.

SUMMARY

In one aspect, a system for producing liquefied natural gas (LNG) is provided that in some implementations can include a liquefied natural gas (LNG) production facility having a heat exchanger configured to receive a methane-containing vapor and to convert the methane-containing vapor to a methane-containing liquid. The heat exchanger can have at least one cooling element configured to receive a vapor having at least one of a flash gas and a boil-off gas from at least a portion of the methane-containing liquid such that the vapor can provide refrigeration to methane-containing vapor within the heat exchanger.

The system can vary in many ways. For example, the system can include a power generation facility that is fluidly coupled to the heat exchanger. The power generation facility can be configured to receive the vapor comprising flash gas and/or boil-off gas, and to use the at least a portion of the vapor comprising flash gas and/or boil-off gas as fuel to generate electric power. The power generation facility can include at least one of a gas turbine, a steam boiler, and a steam turbine.

The power generation facility can be configured to produce mechanical power. In some implementations, the power generation facility is configured to receive at least one of a methane-containing vapor, petrol, diesel, propane, and kerosene, and to use the methane-containing vapor, petrol, diesel, propane, and/or kerosene as fuel to generate at least one of electric power and mechanical power.

In some implementations, the power generation facility and the LNG production facility can be electrically coupled to facilitate delivering electric power, generated in the power generation facility, to the LNG production facility. As another example, the power generation facility and the LNG production facility can be mechanically coupled to facility delivering mechanical power, generated in the power generation facility, to the LNG production facility.

In another aspect, a method or producing liquefied natural gas (LNG) is provided. The method can include introducing a first methane-containing vapor from a natural gas source into a heat exchanger. Heat can be exchanged from the first methane-containing vapor to a refrigerant fluid, and at least a portion of the first methane-containing vapor can condense to form a methane-containing liquid. The method can also include withdrawing at least a portion of the methane-containing liquid from the heat exchanger, creating a vapor comprising at least one of a flash gas and a boil-off gas from the methane-containing liquid, and transferring heat from the refrigerant fluid to the vapor comprising at least one of a flash gas and a boil-off gas from the methane-containing liquid.

The method can vary in many ways. For example, the method can include compressing the refrigerant fluid with an electric-motor driven compressor. In one implementation, at least a portion of the methane-containing vapor can be condensed to form a methane-containing liquid at a temperature greater than approximately −260° F. In some implementations, the vapor comprising a flash gas and/or a boil-off gas can be delivered to a power generation facility and used as fuel to generate electric power. As another example, a second methane-containing vapor from the natural gas source can be delivered to a power generation facility and used as fuel to generate electric power.

In another aspect, a method for producing liquefied natural gas (LNG) is provided. The method can include introducing a first methane-containing vapor into a heat exchanger from a natural gas source. Heat can be exchanged from the first methane-containing vapor to a refrigerant fluid such that at least a portion of the first methane-containing vapor is condensed to form a methane-containing liquid. The method can further include withdrawing at least a portion of the methane-containing liquid from the heat exchanger, and delivering a vapor that includes at least one of a flash gas and boil-off gas from the methane-containing liquid to the heat exchanger to provide refrigeration.

The method can vary in many ways. For example, the methane-containing liquid can have a temperature greater than approximately −260° F. As another example, the methane-containing liquid can be stored at a pressure of less than 5 psig.

In some implementations, the method can include introducing a second methane-containing vapor from the natural gas source to a power generation facility, and using the second methane-containing vapor to generate electric power. The vapor comprising at least one of a flash gas and a boil-off gas can be used as fuel to generate the electric power. The power generation facility can include at least one of a gas turbine, a steam boiler, and a steam turbine that facilitates the generation of electric power. A portion of the electric power that is generated can be used to power at least one electric-motor driven compressor that compresses the refrigerant fluid. Additionally, heat that is produced from generating electric power can be used to provide heat to at least one of a reboiler on an acid gas removal system, a dehydration dryer system, and a reboiler on a hydrocarbon distillation unit.

DETAILED DESCRIPTION

Certain exemplary embodiments will now be described to provide an overall understanding of the principles of the structure, function, manufacture, and use of the systems, devices, and methods disclosed herein. One or more examples of these embodiments are illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

One cost-effective method of storing or transporting natural gas (NG) is to convert it to liquefied natural gas (LNG). Cryogenic refrigeration systems, which are used to produce LNG, require a significant amount of power to operate, and they tend to have a high capital cost. Current practices for producing LNG involve cooling natural gas to about −162° C. (~−260° F.). While that is effective, it can be more efficient to produce LNG at higher temperatures. However, increasing the temperature of LNG production can result in increased generation of vapor byproducts known as flash gas and boil-off gas (BOG). In certain exemplary embodiments, flash gas and BOG generated during LNG production can be heated in a refrigeration recovery system, and used as fuel to create electric power within an LNG and electric power coproduction facility.

Currently, the transportation industry is shifting away from gasoline and diesel fuels toward cleaner transportation fuels and power sources. In order to address the shifting fuel demands, increase the efficiency of LNG production, and maximize the use of flash gas and BOG from an LNG production facility, it can be desirable to produce compressed natural gas (CNG), LNG, and electric power simultaneously. Accordingly, in other exemplary embodiments a single NG feedstock source can be used to produce CNG, LNG, and electric power which can be delivered to a vehicle fueling station.

There are currently vehicles that use LNG and electric power as fuel. In order to address the shifting fuel demands, increase the efficiency of LNG production, and maximize the use of flash gas and BOG from an LNG liquefaction facility, it can be desirable to produce compressed natural gas (CNG), LNG, and electric power simultaneously.

Figure 1:
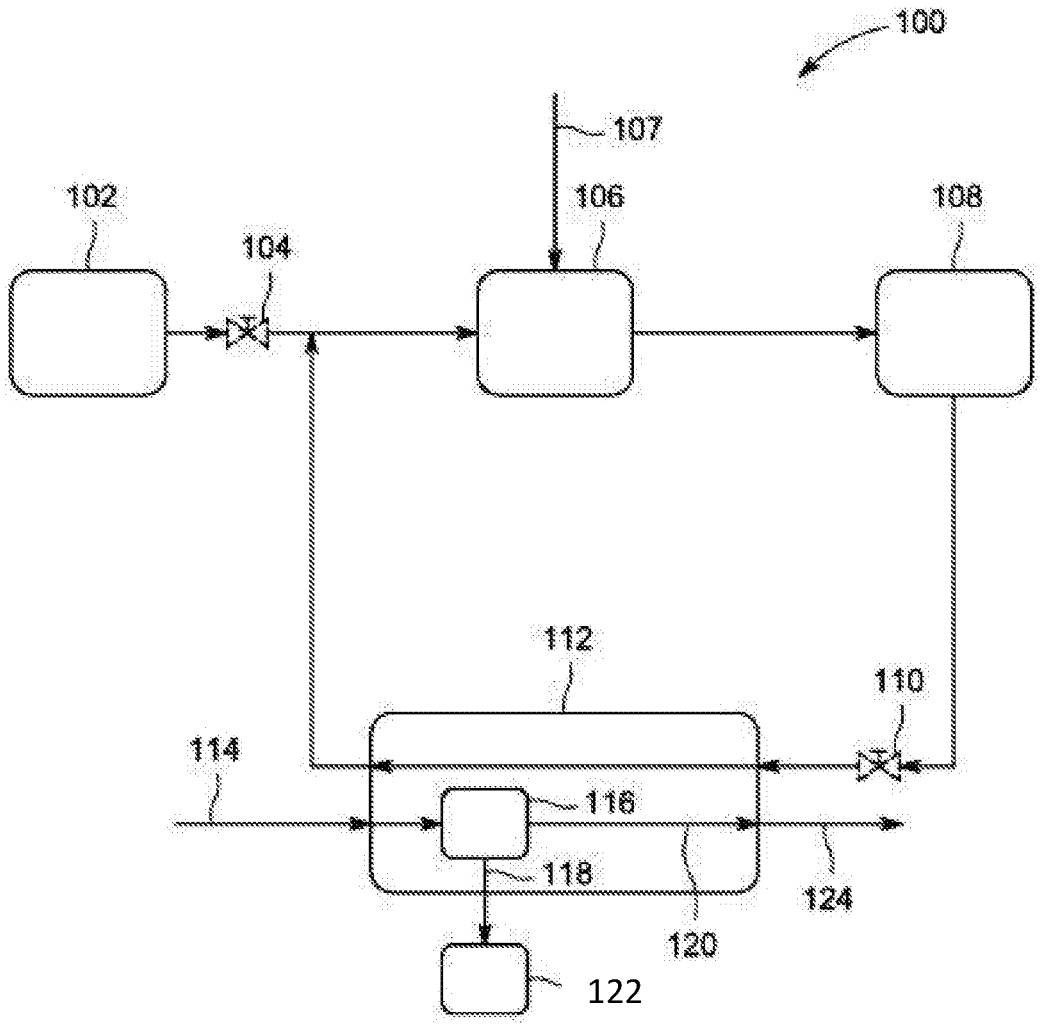
FIG. 1 is a diagram of one embodiment of an LNG liquefaction system.

FIG. 1 is a diagram showing one embodiment of an LNG liquefaction system 100 of an LNG production facility. The liquefaction system 100 can include a refrigerant supply system 102 that can introduce a mixed refrigerant (MR), via a valve 104, to the liquefaction system 100. Initially, low-pressure, low-temperature MR vapor can be delivered to a compression system 106. The compression system 106 can be, e.g., a multistage compression system having multiple compressors. The compressors can be driven by electric motors that can receive electric power 107 from an external power source. When the MR leaves the compression system 106, it can be in a high-temperature, high-pressure, vapor state. The MR can subsequently flow to condensers/aftercoolers 108 that are downstream of the compression system 106. Alternatively and/or additionally, condensers, intercoolers, or air coolers can be located between stages of the compressors of the compression system 106. The condensers/intercoolers/aftercoolers, or other heat exchanger, 108 can facilitate a phase change of the MR from vapor, or mostly vapor, to a predominantly liquid state by removing excess heat generated during the compression process. Once at least a portion of the MR is in a condensed state it can travel through an expansion valve 110, which can create a pressure drop that can put at least a portion of the MR in a low-pressure, low-temperature, liquid state. The liquid MR can be then delivered to a heat exchanger 112 to cool incoming natural gas (NG) feedstock 114. The heat exchanger 112 can be, e.g., a core plate and fin style heat exchanger. Alternatively, other heat exchangers (i.e. core, etched plate, diffusion bonded, wound coil, shell and tube, plate-and-frame) can be used. It is noted that one skilled in the art will have a basic understanding of how heat exchangers work, and will know that refrigerants can travel through cooling passages, cooling elements, or within a shell, to provide refrigeration to a "hot fluid" such as NG feedstock. As the NG and MR travel through the heat exchanger 112, heat can be transferred from the NG feedstock 114 to the MR such that the NG 114 begins to condense.

NG feedstock 114 can often contain heavy hydrocarbon components (HHCs) such as butanes, pentanes, hexanes, benzene, toluene, ethylbenzene, and xylenes. It can be desirable to remove HHCs during production to prevent them from freezing at typical LNG production temperatures. As illustrated in FIG. 1, the heat exchanger 112 can include a HHC separation system 116 that can facilitate removal of HHCs. As the NG feedstock 114 is cooled within the heat exchanger, HHCs can condense at higher temperatures than lighter molecules, e.g., methane. Therefore, liquid 118 containing primarily HHCs can be separated from the remaining NG vapor 120 within the HHC separation system 116, and stored in a HHC storage vessel 122. The remaining NG vapor can continue through the heat exchanger and condense to form LNG 124. The LNG 124 can then be let down in pressure, and stored in a storage vessel (not shown). The MR that leaves the heat exchanger can be predominantly a vapor, and can travel to the compression system to continue the cycle. In some cases, the HHC liquid can be put through a multistage distillation process to separate it into its constituent components. It is noted that the diagram illustrated in FIG. 1 is not intended to describe the geometry of the liquefaction system, or any of the components within the liquefaction system.

During production, LNG is typically cooled to approximately −162° C. (~−260° F.) to minimize vapor generation that can result from pressure let-down and heat leakage.

Once the LNG has been produced, the pressure of the LNG can be reduced by passing it through one or more pressure let-down devices, e.g., flash valves (also known as pressure let-down valves), and flash vessels, and into a low pressure storage vessel. Alternatively, as another example, a turbine can be used to reduce the pressure of the LNG rather than a valve. Each sequential reduction in pressure can result is some flash gas being generated, with more flash gas being produced as the pressure is decreased. Additionally, some heat can leak into the low pressure storage vessel and boil some of the LNG to produce boil-off gas (BOG). Overall, the process generally can result in very little flash gas and BOG being generated since the temperature of the LNG is so low. The flash gas and BOG that are produced can be used as stored and distributed as fuel or re-liquefied in another refrigeration process. However, storing or re-liquefying flash gas and BOG can be cost intensive and undesirable.

In certain aspects, the efficiency of an LNG production process can be increased by increasing the temperature of refrigeration during LNG production, which can result in producing LNG at a higher temperature, e.g., between approximately −162° C. (~−260° F.) and −129° C. (~−200° F.). In certain exemplary embodiments, LNG can be produced at certain temperatures, such as, −260° F., −250° F., −230° F., 200° F. This concept can be illustrated by a Carnot cycle efficiency evaluation. The Carnot cycle is a theoretical and reversible thermodynamic cycle. It provides an upper limit on the efficiency that a classical thermodynamic engine can achieve during the conversion of heat into work, or conversely, it provides an upper limit on the efficiency that a refrigeration system can achieve by an application of work (e.g., compressor power) to create a temperature difference (e.g. refrigeration). Thus, refrigeration cycles can be compared against their theoretical Carnot efficiency as the ultimate measure of their efficiency. The Equation for the Carnot efficiency of a refrigeration system (also commonly referred to as the coefficient of performance, COP, CP, CoP) is given below.

$$\eta = \frac{T_C}{T_H - T_C}$$

$T_C$ is the cold source temperature, or the temperature of refrigeration, and $T_H$ is the hot sink temperature, or the ambient temperature. Although increasing the efficiency of an LNG production process can be increased by producing LNG at a higher temperature, i.e., increasing $T_C$, the increased temperature of the LNG can result in significantly more flash gas being generated if the pressure of the LNG is reduced, i.e., when the LNG is passed through flash valves, and flash vessels, and into a low pressure storage vessel. The LNG can generally be stored in the low pressure storage vessel at pressures of ~5 psig or less. BOG can also be generated if heat leaks into the low pressure storage vessel.

An initial thermodynamic evaluation was conducted to estimate the amount of flash gas that can be generated relative to the total LNG produced prior to pressure let-down, as a function of temperature. The evaluation considered flash gas generated at a high pressure flash drum (114.7 psia) and flash gas generated at a low pressure storage tank (15.7 psia). Boil-off gas that can result from heat leaking into the system was not considered. The findings indicated that nearly zero flash gas is generated at an LNG temperature below −260° F. At temperatures between −260° F. and −201° F., the amount of flash gas that can be generated increased from ~0 wt. % to ~23 wt. %. Within that temperature range, the majority of the flash gas was generated at the low pressure storage tank. At temperatures above −201° F., significant flash gas can be generated from both the high pressure flash drum and the low pressure storage tank. Approximately 3.2 wt. % flash gas was generated at an LNG temperature of −251° F., while approximately 10.9 wt. % flash gas was generated at an LNG temperature of −230° F.

Figure 2:
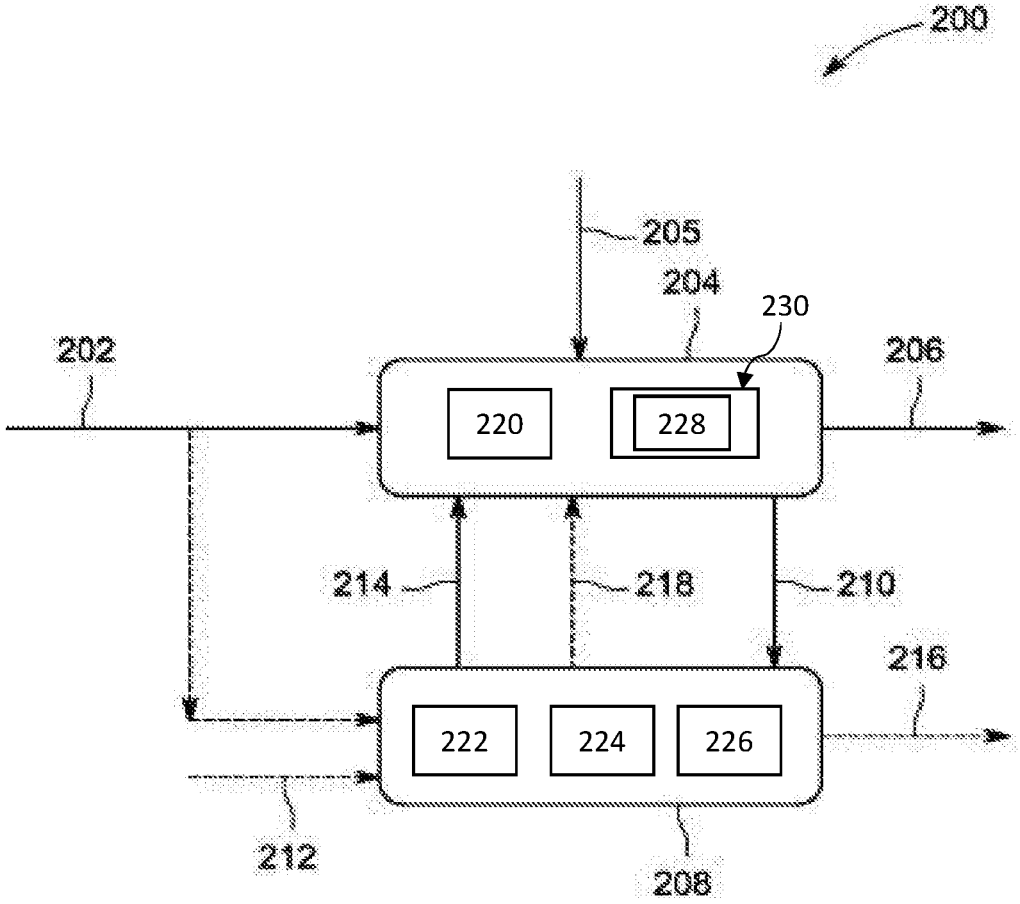
FIG. 2 is a diagram of one embodiment of an LNG and electric power coproduction facility.

One possible application for the flash gas and BOG that is generated is to use it as fuel to create electric power within a power generation facility, as illustrated in FIG. 2. FIG. 2 shows a diagram of one embodiment of an LNG and electric power coproduction facility 200. The coproduction facility 200 can use a single NG feedstock 202 to produce LNG, and electrical power. In the illustrated embodiment, NG feedstock 202 is directed to an LNG production facility 204 to be compressed and condensed to form LNG 206. The LNG production facility can receive electric power 205 from an external power source such as a local power grid, or a battery bank. The electric power 205 can be used, e.g., to power electric-motor driven compressors 220 configured within the LNG production facility 204 that are used to compress a MR within a refrigeration process that cools the incoming NG feedstock 202 to produce the LNG 206. The electric power 205 can also be used to power compressors that compress NG feedstock prior to liquefaction. Additionally, or alternatively, the electric power 205 can be used to power other electric power consuming devices within the LNG production facility 202. The process of condensing NG feedstock 202 to form LNG 206 can generally be similar to that described with respect to FIG. 1, but in this case, flash gas and/or BOG (fuel vapor) 210 can be collected and sent to a power generation facility 208 to be used as fuel, while the LNG 206 can be stored, consumed, or distributed as desired.

The power generation facility 208 can use NG feedstock 202, fuel vapor 210, or other fuels 212, e.g., petrol, diesel, propane, or kerosene, to create electric power. For example, NG feedstock 202, fuel vapor 210, and other fuels 212, can be used as fuel in gas turbines such as simple cycle gas turbines (SCGT) and combined cycle gas turbines (CCGT), as well as steam boilers and steam turbines, to produce mechanical power. A portion of the mechanical power can be used to drive an electric generator to generate electric power. In the illustrated embodiment, some electric power 214 that is generated in the power generation facility 208 can be delivered to the LNG production facility 204 to supplement or replace the electric power 205 from the external source. Another quantity of electric power 216 can be, for example, stored in batteries, diverted to a local power grid, or consumed elsewhere. In some embodiments, NG feedstock 202 is the only fuel that is used for the production of LNG 206 and electric power 214, 216.

During electric power generation, a significant amount of waste heat can be produced. As shown in FIG. 2, some heat 218 can be diverted to the LNG production facility 204. The waste heat 218 can be captured in, e.g., steam, oil, flue gas, NG, or air to be delivered to the LNG production facility 204. The waste heat 218 can be used, for example, as a hot fluid within a reboiler 228 of an acid gas removal system 230, dehydration dryer system, or HHC distillation system. Alternatively, the waste heat can be used in a reboiler 228 of an acid gas removal system 230, which can be used to remove $CO_2$ and/or $H_2S$ from natural gas feedstock, or a dehydration dryer system, which can be used to remove $H_2O$ from natural gas feedstock. HHC distillation systems will be discussed more below.

Figure 3:
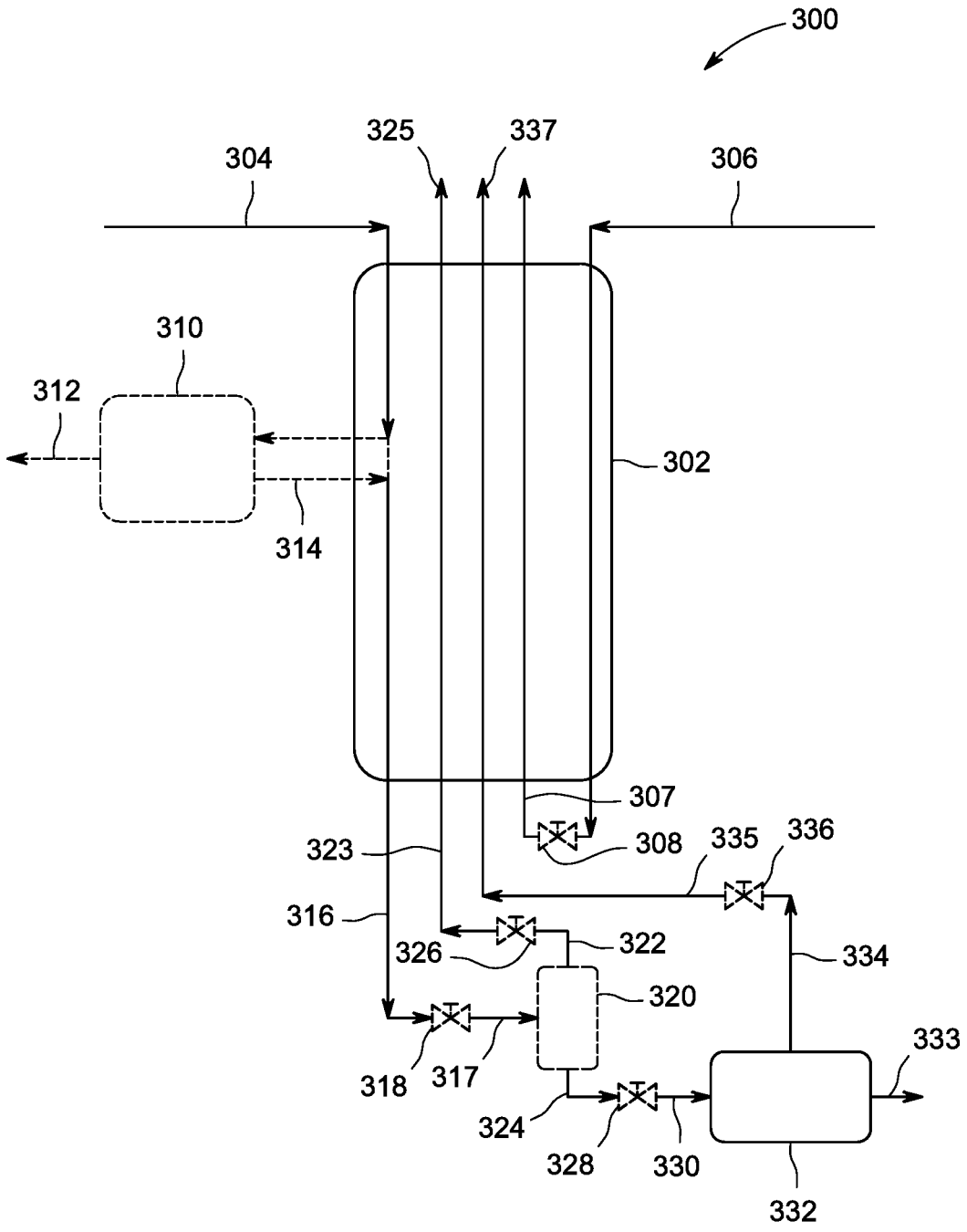
FIG. 3 is a diagram of one embodiment of a refrigeration recovery system that can be used to heat flash gas and BOG during LNG production.

As described above, fuel vapor 210 can be delivered to the power generation facility 208 to be used as fuel to generate electric power. Depending on the configurations of the LNG production facility 204 and the power generation facility 208, it can be desirable to preheat the fuel vapor 210 prior to delivering it to the power generation facility 208 to ensure that it is an appropriate temperature so as not to damage systems within the power generation facility. FIG. 3 illustrates one embodiment of a refrigeration recovery system 300 that can be used to heat flash gas and BOG during LNG production.

The refrigeration recovery system 300 can include a heat exchanger 302 that can receive NG feedstock 304 and liquid MR 306. The heat exchanger 302 can be, e.g., a core plate-and-fin style heat exchanger. Alternatively, other heat exchangers such as core, etched plate, diffusion bonded, wound coil, shell and tube, plate-and-frame, etc. can be used. However, the general design of a core plate-and-fin style heat exchanger can be easily configurable to enable multiple pressure passes in a wide variety of heat transfer configurations. As the NG feedstock 304 and MR 306 travel through the heat exchanger 302, heat can be transferred from the NG feedstock 304 to the MR 306 such that the NG begins to cool and condense. As illustrated in FIG. 3, the MR can travel through a let-down valve 308 as it circulates through the heat exchanger 302. The let-down valve 308 can create a rapid drop in the pressure of the MR 306, which can reduce the temperature of the MR 306, thus ensuring that it remains sufficiently cold to cool incoming NG feedstock 304. In the illustrated embodiment, MR 307 that flows back into the heat exchanger 302 can function to provide refrigeration to the incoming MR 306, as well as the NG feedstock 304. Although one let-down valve 308 is illustrated, the MR can travel through multiple let-down valves prior to leaving the heat exchanger to be delivered to a compression system. Countless variations of the configuration of the MR or other refrigeration are possible, as may be readily conceived and configured within the context to the current invention by one skilled in the art.

As described above with respect to FIG. 1, NG feedstock 304 can often contain heavy hydrocarbon components (HHCs), and it can be desirable to remove HHCs during production to prevent them from freezing at typical LNG production temperatures. As illustrated in FIG. 3, the heat exchanger 302 can include a HHC separation system 310 that facilitates removing HHCs. As the NG feedstock 304 is cooled within the heat exchanger 302, HHCs can condense at higher temperatures than lighter molecules, e.g., methane. Therefore, liquid 312 containing HHCs can be separated from the remaining NG vapor 314 within the HHC separation system 310, and stored in a HHC storage vessel 122. The HHC liquid 312 can be stored in a HHC storage vessel, or delivered to a HHC distillation system, which can in include a reboiler, where it can be separated into its constituent components. The remaining NG vapor can continue through the heat exchanger and condense to form an intermediate LNG 316.

After the intermediate LNG 316 exits the heat exchanger, the pressure of the intermediate LNG 316 can be reduced through a series of flash valves and flash vessels such that it can be stored in a low pressure storage vessel. The LNG can be produced for storage or export at pressures of approximately ~5 psig or less. As shown in FIG. 3, the intermediate LNG 316 can travel through a flash valve 318. The reduction in pressure that results from passing through the flash valve 318 can generate some flash gas. A mixture 317 of flash gas and intermediate LNG can then be directed to a flash vessel 320. More flash gas can be created as a result of another reduction in pressure when the mixture 317 travels through the flash vessel 320. The flash vessel can separate flash gas 322 from LNG 324, and divert the flash gas 322 back to the heat exchanger 302. As the flash gas 322 travels back to the heat exchanger 302, it can pass through a flash valve 326 to achieve a desirable reduction in pressure and temperature, where flash gas 323 that leaves the flash valve 326 can be delivered to the heat exchanger 302.

The remaining LNG 324 can be sent through another flash valve 328 to achieve another reduction in pressure, which can create more flash gas. Pre-storage LNG 330, which can be comprised of LNG and flash gas, is ultimately passed into a low pressure storage vessel 332. The LNG 330 can be stored at, e.g., between 0 and 5 psig, within the storage vessel 332. The reduction in pressure that results from traveling through the flash valve 328 and into the low pressure storage vessel 332 can generate some flash gas, which can be captured within the storage vessel 332. Additionally, heat can leak into the storage vessel 332, which can cause some of the LNG in the storage vessel 332 to boil, thus creating BOG. The flash gasses that are generated during LNG production can be produced at pressures between 0 psig and 150 psig, or higher. Accordingly, the flash gasses can be generated at pressures at or below 150 psig, 100 psig, 50 psig, 20 psig, or 5 psig. The BOG can be generated at pressures between 0 psig and 5 psig, or higher. The combination of flash gas/BOG 334 within the storage vessel 332 can be extracted and diverted through another flash valve 336, along a path toward the heat exchanger 302. Flash gas/BOG 335 that exits the flash valve 336 can continue to travel to the heat exchanger 302. An LNG product 333 can be extracted from the storage tank 332 for consumption or distribution, e.g., via pipeline export, as desired.

The flash gasses and BOG 323, 335 can enter the heat exchanger 302 at temperatures between approximately −162° C. (~−260° F.) and −129° C. (~−200° F.). In certain exemplary embodiments, the flash gasses and BOG can enter the heat at changer at a temperature of −260° F., −250° F., −230° F., or 200° F. As the flash gasses and BOG 323, 335 travel through cooling passages, or cooling elements, within the heat exchanger 302, they can provide refrigeration to incoming NG feedstock 304 to supplement refrigeration provided by the incoming MR 306. Upon exiting the heat exchanger 302, flash gases and BOG 325, 337 can be heated sufficiently to be at an appropriate temperature to be delivered to a power generation facility to be used as fuel to generate electric power. For example, depending on the temperature of the NG feedstock and the configuration of the heat exchanger, the flash gases and BOG 325, 337 can be between approximately −74° C. (~−100° F.) and 38° C. (~100° F.). In certain exemplary embodiments, the flash gasses and BOG 325, 337 can be at a temperature of −100° F., −70° F., −20° F., 32° F., or greater than 32° F., upon exiting the heat exchanger 302.

It is noted that the diagram illustrated in FIG. 3 is not intended to describe the geometry of the refrigeration recovery system 300, or any of the components of the refrigeration recovery system. Additionally, the numbers of flash valves, flash vessels, and storage vessels are intended as non-limiting examples only. For example, the LNG can travel through more than one flash valve prior to entering the flash vessel 320. As another example, there can be more than one flash valve along the path from the flash vessel 320 to the heat exchanger 302. Similarly, there can be any number of flash valves between the flash vessel 320 and the storage vessel 332, and between the storage vessel 332 and the heat exchanger 302. Optionally and alternatively, the flash gasses and BOG 323, 335 may be combined in a single stream or separated into additional streams. As another example, the heated flash gasses and BOG 325, 337 can be combined in a single stream or separated into additional streams.

Although the illustration in FIG. 3, and the accompanying description, show and describe that flash gases and BOG 323, 335 can be heated within the heat exchanger 302 by exchanging heat with NG feedstock 304, there are a number of other refrigeration recovery systems that can be implemented to heat flash gas and BOG. For example, flash gas and BOG can be used to cool a MR that flows through an LNG liquefaction system. In one embodiment there is a first heat exchanger that can be used to cool NG to produce LNG, and there is a second heat exchanger that can be downstream from the first heat exchanger, and directly upstream from a compression system that compresses the MR that travels through the first heat exchanger. After the MR exits the first heat exchanger, it can be diverted to the second heat exchanger as a "hot fluid." Flash gas and BOG can be generated as described with regard to FIG. 3, but rather than sending the flash gas and BOG through the first heat exchanger, the flash gas and BOG can be sent through the second heat exchanger to provide refrigeration to MR directly prior to the MR entering the compression system. The second heat exchanger can be, e.g., a multi-pass plate-and-fin heat exchanger. Upon exiting the second heat exchanger, the flash gas and BOG can be heated sufficiently to be at an appropriate temperature for it to be delivered to power generation facility to be used as fuel to generate electric power.

As described above with regard to FIG. 1, LNG liquefaction systems can include multistage compression systems, wherein intercoolers can be located between successive compressor stages. In another embodiment of an LNG production system that includes refrigeration recovery system, a first heat exchanger can be used to cool NG to produce LNG, as described above, and a second heat exchanger can be located within the compression system. For example, if the compression system is a two stage compression system having first and second compressors and intercoolers, the second heat exchanger can be located after the first intercooler, and before the second compressor. After MR exits the first heat exchanger, it can travel to the compression system where it can travel through the first compressor and first intercooler. The MR can then be diverted to the second heat exchanger as a "hot fluid." Flash gas and BOG can be generated as described with regard to FIG. 3, but rather than sending the flash gas and BOG through the first heat exchanger, the flash gas and BOG can be sent through the second heat exchanger to provide refrigeration to MR.

As described above with regard to the LNG and electric power coproduction facility 200, illustrated in FIG. 2, gas turbines, steam boilers, and steam turbines can be used to generate electric power. For example, as shown in FIG. 2, the power generation facility 208 can include a gas turbine 222, a steam boiler 224, and a steam turbine 226. In another embodiment of an LNG production system that includes a refrigeration recovery system, flash gas and BOG that are generated during LNG production can be used to cool air that is delivered to an inlet of a gas turbine. For example, the flash gas and BOG can be generated during LNG production, as described above, and sent to a heat exchanger to provide refrigeration to air that is traveling through the heat exchanger to be delivered to the inlet of the gas turbine. The heated flash gas and BOG can then be delivered to the gas turbine to be used as fuel to generate electric power, as described above.

There is currently a major transition under way in the transportation sector, as the industry is shifting away from gasoline and diesel fuels toward cleaner transportation fuels and power sources. In order to address the shifting fuel demands, increase the efficiency of LNG production, and maximize the use of flash gas and BOG from an LNG liquefaction facility, it can be desirable to produce compressed natural gas (CNG), LNG, and electric power simultaneously. Accordingly, in other embodiments a single NG feedstock source can be used to produce CNG, LNG, and electric power.

Figure 4:
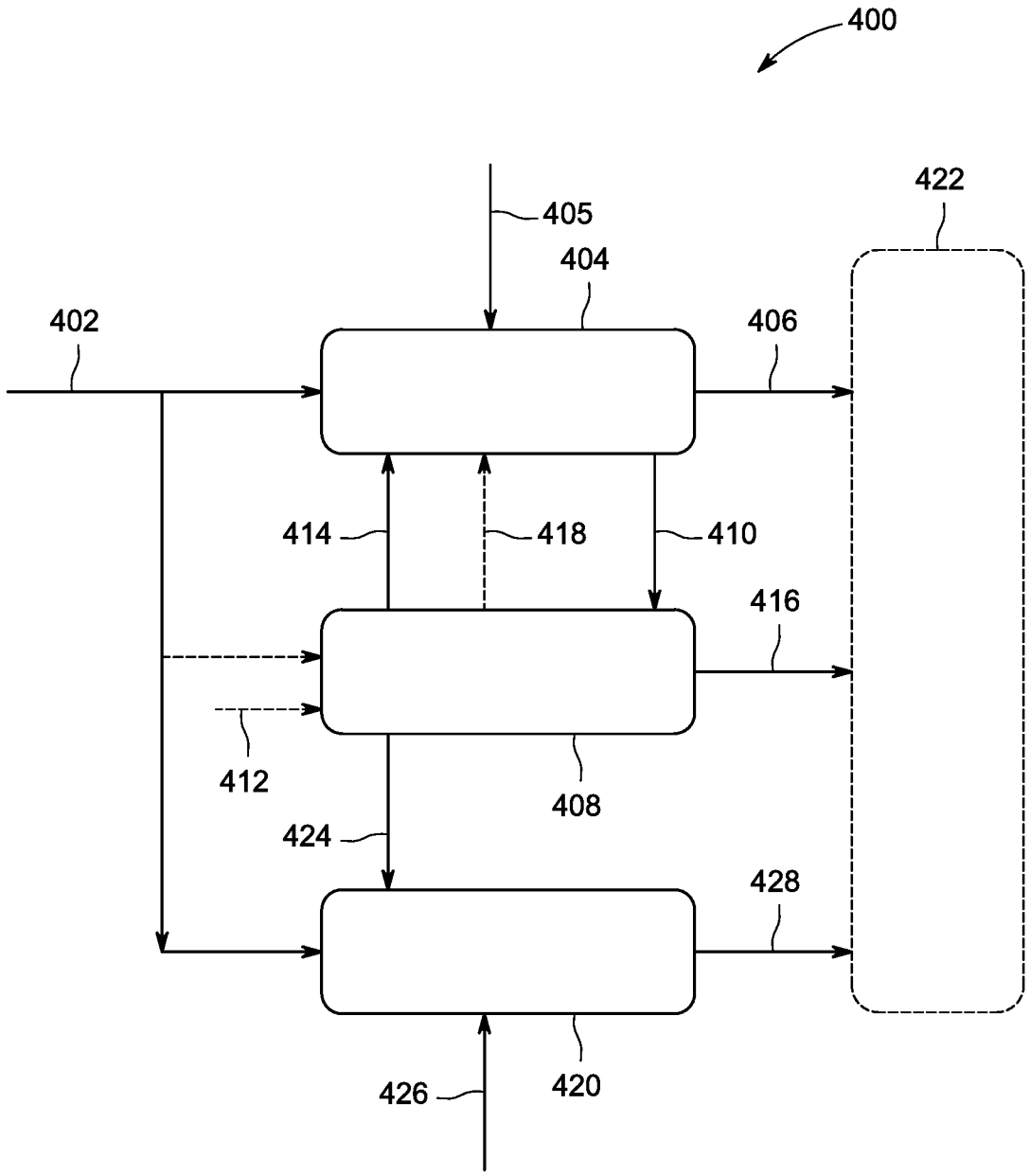
FIG. 4 is a diagram of one embodiment of a vehicle fuel production facility that can produce CNG, LNG, electric power.

FIG. 4 illustrates one embodiment of a vehicle fuel production facility 400 that produces CNG, LNG, and electric power. In the illustrated example, NG feedstock can be directed to an LNG production facility 404, a power generation facility 408, and a CNG production facility 420. The LNG production facility 404 and the power generation facility 408 can generally function and interact similarly to the LNG production facility 204 and power generation facility 208. The LNG production facility 404 can receive a NG feedstock 402 to condense it to produce LNG 406. The LNG can be produced for storage or fueling at temperatures between approximately −162° C. (~−260° F.) and −129° C. (~−200° F.), and at pressures between ~0 psig and ~150 psig, or higher, as described above. The LNG production facility can receive electric power 405 from an external power source such as a local power grid, or a battery bank. The electric power 405 can be used to power electric-motor driven compressors that are used as part of the LNG production process. As one example, the electric power 405 can be used to power compressors that compress the MR that is used within a refrigeration process that cools the incoming NG feedstock 402 to produce the LNG 406. Alternatively, the electric power 405 can be used to power electric-motor driven compressors that are used to compress the NG feedstock 402 prior to liquefaction.

Flash gas and BOG (fuel vapor) 410 that are generated during the production of LNG can be collected and sent to the power generation facility 408 to be used as fuel. Prior to being consumed within the power generation facility 408, the fuel vapor 410 can undergo a refrigeration recovery process as described above with regard to FIG. 3, or one of the alternative embodiments. The LNG 406 that is produced can be delivered to the vehicle fueling facility 422 where it can be stored, consumed, or distributed as desired. Alternatively, or additionally, LNG can be stored within the LNG production facility 404 to be distributed elsewhere. In some cases, all of the LNG that is produced at the LNG production facility 404 can be consumed or distributed at the vehicle fueling facility 422, or it can all be distributed elsewhere, e.g., via pipeline export.

The power generation facility can use NG feedstock 402, fuel vapor 410, or other fuels 412, i.e., petrol, diesel, propane, or kerosene, to create electric power. For example, as described above, NG feedstock 402, fuel vapor 410, and other fuels 412, can be used as fuel in gas turbines such as simple cycle gas turbines (SCGT) and combined cycle gas turbines (CCGT), as well as in steam boilers and steam turbines, to produce mechanical power. A portion of the mechanical power can be used to power an electric generator to generate electric power. In the illustrated embodiment, some electric power 414 that is generated in the power generation facility 408 can be delivered to the LNG production facility 404 to supplement or replace the electric power 405 from the external source. The electric power 414 from the power generation facility can be used, e.g., to power electric-motor driven compressors or other electric power consuming devices. Another portion of the electric power 416 that is generated in the power generation facility 408 can be delivered to the vehicle fueling facility 422 where it can be stored, consumed, or distributed as desired. Alternatively, or additionally, the power generation facility 408 can supply electric power to a local power grid. In some cases, all of the power that is generated in at the power generation facility 408 can be delivered to the vehicle fueling facility 422 where it is distributed or consumed, or it can be distributed elsewhere, e.g., to a local power grid, as electric power. During electric power generation, a significant amount of waste heat can be produced. As shown in FIG. 4, some heat 418 can be diverted to the LNG production facility 404 to be used as described with regard to FIG. 2.

As illustrated in FIG. 4, the CNG production facility can receive electric power 424 from the power generation facility 408 in addition to receiving electric power 426 from an external power source such as a local power grid, or a battery bank. The electric power 424 from the power generation facility 408 can supplement or replace the electric power 426 from the external power source. In either case, the electric power 424, 426 can be used to power electric-motor driven compressors which can function to compress NG feedstock to form CNG 428. In addition to powering compressors within the CNG production facility 420, the electric power 424, 426 can be used to power other electric power consuming systems and devices within the CNG production facility 420. The CNG can be produced for storage or fueling, for example at ambient temperature and pressure up to approximately 3600 psi. The CNG 428 that is produced can be delivered to the vehicle fueling facility 422 where it can be stored, consumed, or distributed as desired. Alternatively, or additionally, CNG can be stored within the CNG production facility 420 to be distributed elsewhere, e.g., via pipeline export. In some cases, all of the CNG that is produced at the CNG production facility 420 can be consumed or distributed at the vehicle fueling facility 422, or it can all be distributed elsewhere, e.g., via pipeline export.

Figure 5:
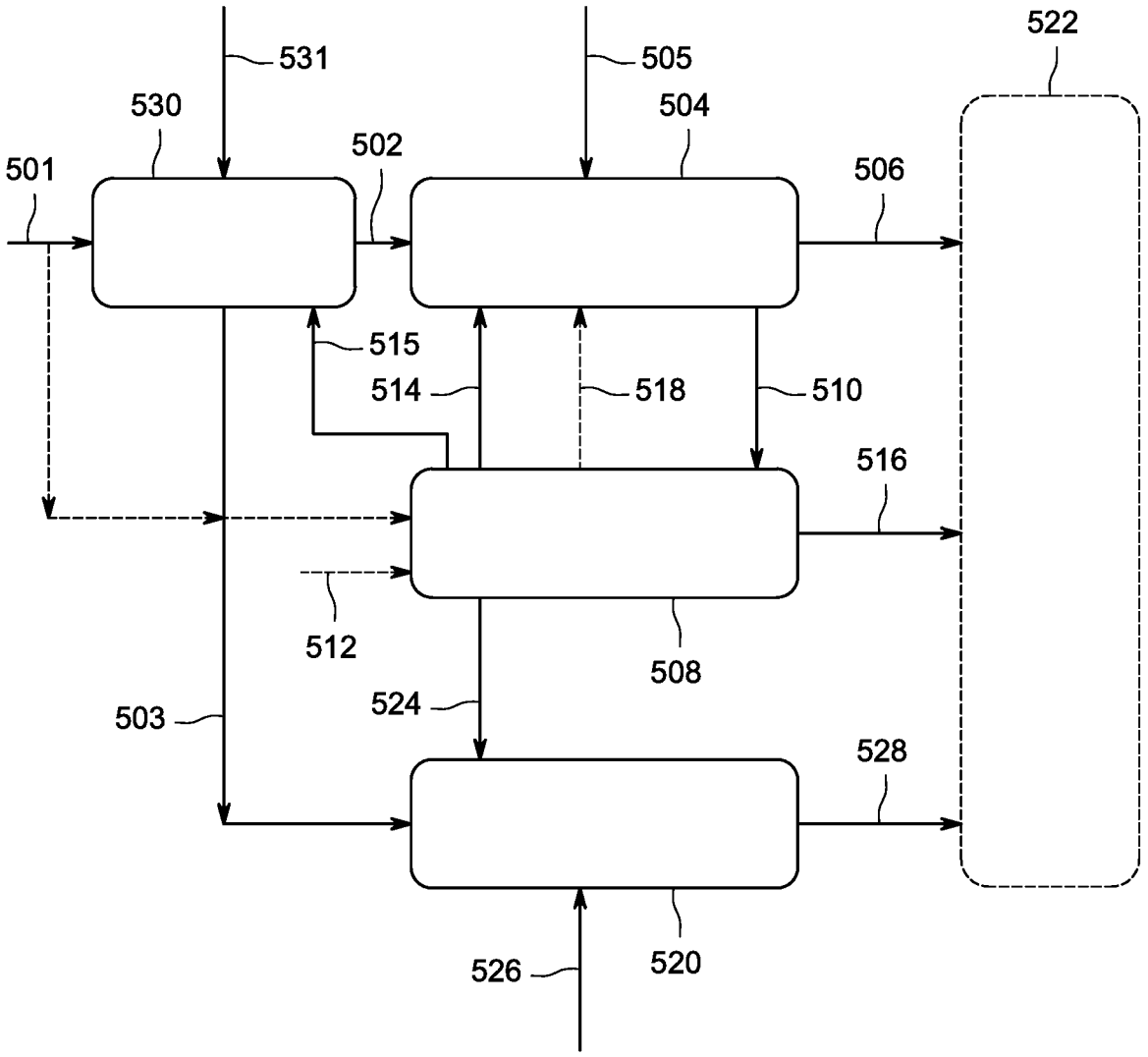
FIG. 5 is a diagram of another embodiment of a vehicle fuel production facility that can produce CNG, LNG, electric power.

In the vehicle fuel production facility 400 shown in FIG. 4, the LNG production facility 404 and the CNG production facility 420 can both include compression systems that compress NG feedstock 402. In some cases, it can be desirable to use a single compression system to compress NG feedstock which will be used to produce LNG and to produce CNG, as shown in FIG. 5. This shared compression system can reduce the capital cost of the vehicle fuel production facility. Alternate compression arrangements for specific systems may also be configured by one skilled in the art.

FIG. 5 illustrates an exemplary vehicle fuel production facility 500 that produces CNG, LNG, electric power. The general interactions and functions of the vehicle fuel production facility 500 can be similar to those of vehicle fuel production facility 400, except in this case, there is a NG compression facility 530 that is external to an LNG production facility 506 and a CNG production facility 520. In the illustrated embodiment, a NG feedstock 501 is delivered to the NG compression facility 530, as well as to a power generation facility 508. The NG production facility 530 can receive electric power 531 from an external source such as a local power grid, or a battery bank, and it can use the electric power 531 to power electric-motor driven compressors that compress a portion of the NG feedstock 501. A portion of the NG feedstock 501 can be compressed in the NG compression facility 530 to produce CNG, where intermediate compressed natural gas 502, 503 are delivered to the LNG production facility 504 and the CNG production facility 520. In some cases, it may be desirable to further compress the intermediate compressed natural gas 502, 503 at the LNG production facility 504 and/or the CNG production facility 520. In such circumstances, the NG compression facility 530 can be responsible for the initial NG compression, while further compression can be carried out at the LNG and/or CNG facilities 504, 520.

The LNG production facility 504, power generation facility 508, and CNG production facility 520 can generally function similarly to LNG production facility 404, power generation facility 408, and CNG production facility 420. The LNG production facility 504 receives intermediate compressed natural gas 502 to condense to produce LNG 506. The LNG production facility 504 can receive electric power 505 from an external power source such as a local power grid, or a battery bank. The electric power 405 can be used to power electric-motor driven compressors that are used as part of the LNG production process. For example, the electric power 505 can be used to power compressors that compress MR that is used within a refrigeration process that cools the incoming intermediate compressed natural gas 502 to produce the LNG 506. Alternatively, the electric power 505 can be used to power electric-motor driven compressors that are used to further compress intermediate compressed natural gas 502 prior to liquefaction.

Flash gas and BOG (fuel vapor) 510 that are generated during LNG production can be delivered to the power generation facility 508 to be used as fuel to generate electric power, as described above with regard to FIG. 2 and FIG. 4. Prior to being consumed within the power generation facility 508, the fuel vapor 510 can undergo a refrigeration recovery process as described above with regard to FIG. 3, or one of the alternative embodiments. The LNG 506 that is produced can be delivered to the vehicle fueling facility 522 where it can be stored, consumed, or distributed as desired. Alternatively, or additionally, LNG can be stored within the LNG production facility 504 to be distributed elsewhere.

Similar to power generation facility 408, power generation facility 508 can use NG feedstock 501, fuel vapor 510, or other fuels 512, i.e., petrol, diesel, propane, or kerosene, to create electric power. In the illustrated embodiment, some electric power 514 that is generated in the power generation facility 508 can be delivered to the LNG production facility 504 to supplement or replace the electric power 505 from the external source. In this embodiment, some electric power 515 can also be delivered to the NG compression facility 530. The electric power 515 that is delivered to the NG compression facility 530 can replace or supplement the electric power 531 that is from the external source.

The power generation facility 508 can also generate electric power 516 which can be delivered to the vehicle fueling facility 522 where it can be stored, consumed, or distributed as desired, e.g. for charging of an electric vehicle. Alternatively, or additionally, the power generation facility 408 can supply electric power to a local power grid. During electric power generation, a significant amount of waste heat can be produced. As shown in FIG. 5, some heat 518 can be diverted to the LNG production facility 504 to be used as described with regard to heat 218 shown in FIG. 2. In some cases, all of the power that is generated at the power generation facility 508 can be delivered to the vehicle fueling facility 522 where it can be distributed or consumed, or it is distributed elsewhere, e.g., to a local power grid, as electric power.

As illustrated in FIG. 5, the CNG production facility can receive electric power 524 from the power generation facility 508 in addition to receiving electric power 526 from an external power source such as a local power grid, or a battery bank. The electric power 524 from the power generation facility 508 can supplement or replace the electric power 506 from the external power source. In either case, the electric power 524, 526 can be used to power electric-motor driven compressors which can function to further compress intermediate compressed natural gas 503 to form CNG 528. In addition to powering compressors within the CNG production facility 520, the electric power 524, 526 can be used to power other electric power consuming systems and devices within the CNG production facility 520. The CNG can be produced for storage or fueling at ambient temperature and at pressure up to approximately 3600 psi. The CNG 528 that is produced can be delivered to the vehicle fueling facility 522 where it can be stored, consumed, or distributed as desired. Alternatively, or additionally, CNG can be stored within the CNG production facility 520 to be distributed elsewhere.

As described above with regard to FIG. 4, some or all of the CNG, LNG, and electric power that is generated can be delivered to the vehicle fueling facility 522 where it can be consumed or distributed. Alternatively, each of the fuels can be distributed elsewhere. For example, the CNG can be distributed via pipeline export, the LNG can be exported via truck, ship, rail, or pipeline, and the electric power can be exported to a local power grid.

Although MR is used in the embodiments described herein, alternate refrigerants can be used within refrigeration systems and within the methods, systems, and devices described herein. Examples of alternate refrigerants include ammonia, propane, nitrogen, methane, ethane, ethylene, or other industrial gas or hydrocarbon based refrigerants.

Exemplary technical effects of the methods, systems, and devices described herein include, by way of non-limiting example, the ability to produce an intermediate LNG at higher temperatures to improve the efficiency of the LNG liquefaction process. Exemplary technical effectors also include the ability to generate LNG, CNG, and electrical power using at least a portion of a single natural gas source, and to provide LNG, CNG, and electrical power at a vehicle fueling facility. The aforementioned methods, systems, and devices, can function to increase the efficiency of LNG production, maximize the use of flash gas and BOG from an LNG liquefaction facility, and address shifting vehicle fuel demands.

One skilled in the art will appreciate further features and advantages of the subject matter described herein based on the above-described embodiments. Accordingly, the present application is not to be limited specifically by what has been particularly shown and described.

What is claimed is:

1. A system for producing liquefied natural gas (LNG), comprising:

a liquefied natural gas (LNG) production facility having a reboiler configured within an acid gas removal system of the liquefied natural gas (LNG) production facility and a heat exchanger to receive a methane-containing vapor and to convert the methane-containing vapor to a methane-containing liquid, the heat exchanger having at least one cooling element including a cooling passage to receive a vapor comprising at least one of a flash gas and a boil-off gas from at least a portion of the methane-containing liquid such that the vapor provides refrigeration to methane-containing vapor within the heat exchanger, and a power generation facility that is fluidly coupled to the heat exchanger and includes at least one of a gas turbine, a steam boiler, and a steam turbine that facilitates generation of electrical power, the power generation facility being configured to receive the vapor comprising at least one of a flash gas and a boil-off gas, and use the at least a portion of the vapor comprising at least one of a flash gas and a boil-off gas as fuel to generate electric power, wherein the power generation facility and the liquefied natural gas (LNG) production facility are electrically coupled to facilitate delivering electric power, generated in the power generation facility, to the LNG production facility and the heat that is produced from generating electric power is used to provide heat to the reboiler of the acid gas removal system.

2. The system of claim 1, wherein the power generation facility receives at least one of a methane-containing vapor, petrol, diesel, propane, and kerosene, and to use the at least one of a methane-containing vapor, petrol, diesel, propane, and kerosene as fuel to generate at least one of electric power and mechanical power.

3. The system of claim 1, wherein the power generation facility produces mechanical power.

4. The system of claim 3, wherein the power generation facility and the LNG production facility are mechanically coupled to facilitate delivering mechanical power, generated in the power generation facility, to the LNG production facility.

5. A method for producing liquefied natural gas (LNG), comprising:

introducing a first methane-containing vapor from a natural gas source into a heat exchanger, wherein heat is exchanged from the first methane-containing vapor to a refrigerant fluid such that at least a portion of the first methane-containing vapor condenses to form a methane-containing liquid;

introducing a second methane-containing vapor from the natural gas source to a power generation facility, and using the second methane-containing vapor to generate electric power, wherein the power generation facility includes at least one of a gas turbine, a steam boiler, and a steam turbine that facilitates the generation of electric power and heat that is produced from generating electric power is used to provide heat to a reboiler on an acid gas removal system;

withdrawing at least a portion of the methane-containing liquid from the heat exchanger;

creating a vapor comprising at least one of a flash gas and a boil-off gas from the methane-containing liquid; and delivering the vapor comprising at least one of a flash gas and boil-off gas to the heat exchanger to provide refrigeration.

6. The method of claim 5, wherein at least a portion of the first methane-containing vapor is condensed to form a methane-containing liquid at a temperature greater than approximately −260° F.

7. The method of claim 5, further comprising compressing the refrigerant fluid with an electric-motor driven compressor.

8. The method of claim 5, wherein the vapor comprising at least one of a flash gas and a boil-off gas is delivered to a power generation facility and used as fuel to generate electric power.

9. The method of claim 5, wherein the methane-containing liquid has a temperature greater than approximately −260° F.

10. The method of claim 5, wherein the vapor comprising at least one of a flash gas and a boil-off gas is used as fuel to generate the electric power.

11. The method of claim 5, wherein a portion of the electric power that is generated is used to power at least one electric-motor driven compressor that compresses the refrigerant fluid.

12. The method of claim 5, wherein the methane-containing liquid is stored at a pressure of less than 5 psig.

* * * * *